US012741171B2

(12) United States Patent
Jones et al.

(10) Patent No.: US 12,741,171 B2
(45) Date of Patent: Sep. 22, 2026

(54) CONNECTOR ASSEMBLY

(71) Applicant: Coulter Ventures, LLC., Columbus, OH (US)

(72) Inventors: Ahmik Jones, Upper Arlington, OH (US); Emmanuel Sergakis, Plain City, OH (US); William Henniger, Columbus, OH (US); Nicolas Garcia, Centerburg, OH (US)

(73) Assignee: Coulter Ventures, LLC., Columbus, OH (US)

( * ) Notice: Subject to any disclaimer, the term of this patent is extended or adjusted under 35 U.S.C. 154(b) by 76 days.

(21) Appl. No.: 18/820,764

(22) Filed: Aug. 30, 2024

(65) Prior Publication Data

US 2025/0065181 A1 Feb. 27, 2025

Related U.S. Application Data

(63) Continuation of application No. 17/750,778, filed on May 23, 2022, now Pat. No. 12,076,604, which is a continuation of application No. 16/657,531, filed on Oct. 18, 2019, now Pat. No. 11,364,407.

(60) Provisional application No. 62/747,953, filed on Oct. 19, 2018.

(51) Int. Cl.
*A63B 21/072* (2006.01)

(52) U.S. Cl.
CPC ..... *A63B 21/0728* (2013.01); *A63B 2209/00* (2013.01)

(58) Field of Classification Search
CPC ..... A63B 21/072–075; A63B 21/06–08
See application file for complete search history.

(56) References Cited

U.S. PATENT DOCUMENTS

| | | | |
|---|---|---|---|
| 1,645,457 A | 10/1927 | Schall | |
| 2,470,815 A | 5/1949 | Roosevelt | |
| 2,820,241 A | 1/1958 | Schlage | |
| 3,056,226 A | 10/1962 | Hubbard et al. | |
| 3,198,563 A | 8/1965 | Steidl | |
| 3,305,234 A | 2/1967 | Cline | |

(Continued)

FOREIGN PATENT DOCUMENTS

| | | | | |
|---|---|---|---|---|
| GB | 2493185 A * | 1/2013 | ..... | A63B 21/075 |
| KR | 101626945 B1 * | 6/2016 | ..... | A63B 21/0728 |

(Continued)

OTHER PUBLICATIONS

Product listing for Rogue Monster Plate Storage Pin from https://web.archive.org/web/20170423182638/http://www.roguefitness.com/rogue-monster-plate-storage-pin, dated Apr. 23, 2017.

(Continued)

*Primary Examiner* — Nyca T Nguyen
(74) *Attorney, Agent, or Firm* — Banner & Witcoff, Ltd.

(57) ABSTRACT

A connector assembly includes a shaft and a first annular knob fixed to the shaft and a second annular knob releasably engaged with the shaft. Each of the first and second annular knobs includes a front face, a face, and a central passage that receives the shaft. The central passage has first, second, and third sections. The width of each first section is greater than the width of the third section, and the width of the second section is greater than the width of the first section. The second section defines an annular slot between the first and third sections.

24 Claims, 14 Drawing Sheets

(56) References Cited

U.S. PATENT DOCUMENTS

D248,114 S 6/1978 Mangiapane
D263,555 S 3/1982 Curtis
D279,495 S 7/1985 Barbeau
D280,433 S 9/1985 Lincir
4,579,337 A 4/1986 Uyeda
4,679,788 A 7/1987 Adler
4,681,315 A 7/1987 Yang
4,711,106 A 12/1987 Johnson
4,773,641 A 9/1988 Metz
D306,886 S 3/1990 Shiek et al.
5,049,900 A 9/1991 Bidner et al.
5,090,693 A 2/1992 Liang
5,203,753 A 4/1993 Rothhammer
5,209,481 A * 5/1993 DeBack ..... A63B 21/4047 473/220
5,221,244 A 6/1993 Doss
5,391,133 A 2/1995 Ruffa
D358,856 S 5/1995 Boettger, Jr.
5,464,379 A 11/1995 Zarecky
D367,902 S 3/1996 Silk
5,518,478 A 5/1996 Liang
5,556,362 A 9/1996 Whipps
D374,897 S 10/1996 Whisman
5,692,981 A 12/1997 Whisman
5,697,871 A 12/1997 Landfair
5,720,695 A * 2/1998 Eckmann ..... A63B 21/4047 482/96
5,799,937 A * 9/1998 Nolan ..... A63B 60/16 473/457
D401,649 S 11/1998 Bellehumeur
5,839,977 A 11/1998 Maurer et al.
5,997,597 A 12/1999 Hagan
6,007,268 A 12/1999 Whittington et al.
D421,762 S 3/2000 Shirley et al.
6,059,700 A 5/2000 Ellenburg
D428,795 S 8/2000 Wyers
D431,114 S 9/2000 Smith et al.
6,123,651 A 9/2000 Ellenburg
6,132,345 A 10/2000 Beierschmitt et al.
D444,050 S 6/2001 Wyers
D447,043 S 8/2001 Wyers
6,315,699 B1 11/2001 Romero
6,412,315 B1 7/2002 Cheng et al.
D461,392 S 8/2002 Zapushek
D464,094 S 10/2002 Fond
6,551,222 B1 * 4/2003 Beaver ..... A63B 5/20 482/82
6,602,169 B1 8/2003 Patti
6,689,022 B1 2/2004 Emick
6,722,170 B2 4/2004 Squier
D493,518 S 7/2004 McAllister et al.
D496,414 S 9/2004 Harms et al.
6,862,905 B2 3/2005 Zapushek
6,875,161 B1 4/2005 Brice
D504,923 S 5/2005 Harms et al.
D519,584 S 4/2006 Brice et al.
7,048,678 B2 5/2006 Harms et al.
7,097,601 B1 * 8/2006 Ronnow ..... A63B 21/072 482/106
7,131,938 B2 * 11/2006 Cao ..... A63B 21/075 482/106
7,225,649 B2 6/2007 Wyers
7,311,641 B2 * 12/2007 Panagos ..... A63B 21/072 482/106
D561,001 S 2/2008 Rohde et al.
D561,852 S 2/2008 Frey
7,334,499 B2 * 2/2008 Lai ..... B62K 21/26 74/551.9
D579,993 S 11/2008 Fairchild et al.
D581,248 S 11/2008 Wu et al.
D581,249 S 11/2008 Wu et al.
7,491,156 B1 2/2009 GaoYong
D589,779 S 4/2009 Wrase et al.
7,533,597 B1 5/2009 Strohman
D594,311 S 6/2009 Stevens
7,591,772 B2 9/2009 Shillington
7,594,874 B2 9/2009 Meissner
D605,927 S 12/2009 Wyers
D615,605 S 5/2010 Frasco et al.
7,740,569 B2 * 6/2010 Patti ..... A63B 21/0726 482/106
7,775,948 B2 8/2010 Chen
7,819,786 B1 * 10/2010 Cao ..... A63B 21/0726 482/106
8,033,964 B1 10/2011 Chen
D653,715 S 2/2012 Tumminia
8,201,844 B1 6/2012 Smoot
8,210,996 B2 7/2012 Anderson
8,302,435 B2 11/2012 Burmesch et al.
8,303,225 B2 11/2012 Kearl et al.
8,500,609 B1 8/2013 Williams
D692,970 S 11/2013 Lien
D694,091 S 11/2013 Gartner
D696,723 S 12/2013 Livingstone
D709,754 S 7/2014 Lylyk et al.
8,808,151 B1 8/2014 Whaley
8,876,396 B2 11/2014 Guilford
D720,201 S 12/2014 Gokcebay et al.
8,951,169 B1 2/2015 Casper
8,974,354 B1 3/2015 Nelson et al.
8,986,173 B1 3/2015 Adams
9,126,079 B2 9/2015 Jordan
9,132,315 B1 9/2015 Chen
D740,897 S 10/2015 Miltner et al.
D747,640 S 1/2016 Scalisi
9,314,661 B1 4/2016 Chen
9,327,159 B1 * 5/2016 Medina ..... A63B 21/0726
D758,167 S 6/2016 Gartner
D758,168 S 6/2016 Gartner
9,427,613 B2 * 8/2016 Jordan ..... A63B 21/4035
D770,881 S 11/2016 Gartner
9,526,941 B2 12/2016 Wu
D777,851 S 1/2017 Simonetti
9,610,490 B2 4/2017 Tambornino et al.
D793,205 S 8/2017 Ho et al.
D795,041 S 8/2017 Oliva Camacho et al.
D796,298 S 9/2017 Lylyk et al.
9,874,042 B2 1/2018 Gartner
D830,811 S 10/2018 Frantz
D837,031 S 1/2019 Cavanna et al.
D843,197 S 3/2019 Dempsey et al.
D843,524 S 3/2019 Henniger
D846,044 S 4/2019 Peritz
10,357,675 B1 7/2019 Katz
D857,132 S 8/2019 Dube
D857,143 S 8/2019 Mateko
10,391,377 B1 8/2019 Sorin
10,456,617 B1 10/2019 Allison
10,458,838 B2 10/2019 Lee
10,493,313 B2 12/2019 Jones et al.
D876,924 S 3/2020 Xie et al.
10,576,322 B2 3/2020 Schlegel
D884,097 S 5/2020 Ameri et al.
D884,467 S 5/2020 Suen
D885,864 S 6/2020 Garcia
D891,147 S 7/2020 Denby et al.
D891,545 S 7/2020 Jones et al.
D892,240 S * 8/2020 Sergakis ..... D21/694
D893,642 S 8/2020 Henniger et al.
D909,176 S 2/2021 Garcia
D912,743 S * 3/2021 Sergakis ..... D21/694
D919,422 S 5/2021 Stilson
D923,107 S 6/2021 Overstreet, Jr.
D932,280 S 10/2021 Garcia
D949,989 S * 4/2022 Jones ..... D21/694
11,364,407 B2 * 6/2022 Jones ..... A63B 21/0728
2001/0049324 A1 12/2001 Wallace et al.
2003/0232705 A1 12/2003 Harms et al.
2004/0086325 A1 5/2004 Friesen et al.
2006/0096876 A1 5/2006 Scott
2007/0240281 A1 10/2007 Meissner
2007/0243976 A1 10/2007 Cao

(56) References Cited

U.S. PATENT DOCUMENTS

| | | | | |
|---|---|---|---|---|
| 2007/0249475 | A1* | 10/2007 | Cao | A63B 21/0728 482/106 |
| 2007/0298940 | A1* | 12/2007 | Anderson | A63B 21/0728 482/107 |
| 2008/0171643 | A1 | 7/2008 | Baudhuin | |
| 2008/0220952 | A1 | 9/2008 | Yang | |
| 2009/0023563 | A1 | 1/2009 | Liang | |
| 2009/0131232 | A1* | 5/2009 | Chen | A63B 21/0728 482/104 |
| 2009/0192027 | A1 | 7/2009 | Parker | |
| 2009/0239719 | A1 | 9/2009 | Patti | |
| 2010/0075816 | A1 | 3/2010 | Anderson | |
| 2010/0190618 | A1 | 7/2010 | Chen | |
| 2011/0021327 | A1* | 1/2011 | Lien | A63B 21/0728 482/107 |
| 2012/0006836 | A1 | 1/2012 | Chen | |
| 2013/0040788 | A1 | 2/2013 | Booker et al. | |
| 2013/0274077 | A1 | 10/2013 | Greenberg et al. | |
| 2013/0288862 | A1 | 10/2013 | Lien | |
| 2014/0087928 | A1 | 3/2014 | Luedeka | |
| 2014/0106943 | A1 | 4/2014 | Simonetti | |
| 2014/0121073 | A1 | 5/2014 | Hardy | |
| 2014/0162850 | A1 | 6/2014 | Chen | |
| 2014/0274591 | A1 | 9/2014 | Miltner et al. | |
| 2014/0323274 | A1 | 10/2014 | Moy | |
| 2015/0016869 | A1 | 1/2015 | Suzuki | |
| 2015/0016919 | A1 | 1/2015 | Tambornino et al. | |
| 2015/0133274 | A1 | 5/2015 | Simonetti | |
| 2015/0297942 | A1 | 10/2015 | Tully | |
| 2015/0335931 | A1* | 11/2015 | Jordan | A63B 21/4035 482/82 |
| 2015/0343288 | A1 | 12/2015 | Taggart | |
| 2016/0030797 | A1* | 2/2016 | Erickson | A63B 23/0211 482/132 |
| 2016/0059062 | A1 | 3/2016 | Simonetti | |
| 2016/0082304 | A1 | 3/2016 | Behle et al. | |
| 2016/0082794 | A1 | 3/2016 | Mauerman et al. | |
| 2016/0101320 | A1 | 4/2016 | Tsutsui et al. | |
| 2016/0228739 | A1 | 8/2016 | Wu | |
| 2017/0001064 | A1 | 1/2017 | Vorozilchak et al. | |
| 2017/0136279 | A1 | 5/2017 | Biddle | |
| 2017/0234706 | A1 | 8/2017 | Martin et al. | |
| 2017/0246495 | A1* | 8/2017 | Wyncott | A63B 21/072 |
| 2017/0259103 | A1 | 9/2017 | Simonetti | |
| 2017/0340916 | A1 | 11/2017 | Gennusa | |
| 2018/0142832 | A1* | 5/2018 | Inouye | F16M 13/022 |
| 2018/0243597 | A1 | 8/2018 | Schlegel | |
| 2018/0272175 | A1* | 9/2018 | Henniger | A63B 21/0726 |
| 2018/0296870 | A1 | 10/2018 | Gangemi et al. | |
| 2019/0015288 | A1* | 1/2019 | Merrill | A61H 7/007 |
| 2019/0038927 | A1 | 2/2019 | Wilhelm et al. | |
| 2019/0105528 | A1* | 4/2019 | Bardakci | A63B 23/14 |
| 2019/0184256 | A1 | 6/2019 | Mainini et al. | |
| 2019/0247701 | A1 | 8/2019 | Sergakis et al. | |
| 2019/0275363 | A1 | 9/2019 | Jones et al. | |
| 2019/0350793 | A1 | 11/2019 | Wersland et al. | |
| 2019/0381359 | A1* | 12/2019 | Polig | A63B 69/0048 |
| 2019/0388723 | A1 | 12/2019 | Nalley et al. | |
| 2020/0023698 | A1 | 1/2020 | Tsai | |
| 2020/0047020 | A1 | 2/2020 | Harms | |
| 2020/0078266 | A1* | 3/2020 | Miller | A63B 21/06 |
| 2020/0114195 | A1* | 4/2020 | Henniger | A63B 21/0628 |
| 2020/0121973 | A1* | 4/2020 | Jones | A63B 21/0726 |
| 2020/0147439 | A1* | 5/2020 | Acuna, Jr. | A63B 21/4035 |
| 2022/0072361 | A1* | 3/2022 | Henniger | A63B 21/154 |
| 2023/0011149 | A1* | 1/2023 | Jones | A63B 21/0726 |

FOREIGN PATENT DOCUMENTS

| | | | | |
|---|---|---|---|---|
| KR | 101918861 | B1 * | 11/2018 | A63B 21/0726 |
| WO | WO-2019053603 | A1 * | 3/2019 | A63B 21/072 |

OTHER PUBLICATIONS

Photos of Rogue Monster Plate Storage Pin from https://web.archive.org/web/20170423182638/http://www.roguefitness.com/rogue-monster-plate-storage-pin, dated Apr. 23, 2017.

Product photo posted at https://www.facebook.com/roguefitness/photos/a.128475269459/10157445836814460/?type=3&theater, dated Sep. 28, 2018.

Product photo posted at https://www.facebook.com/roguefitness/photos/a.128475269459/10157445836759460/?type=3&theater, dated Sep. 28, 2018.

Product listing from https://www.roguefitness.com/rogue-monster-keyhole-keyless-plate-storage-pin, product disclosed prior to Oct. 19, 2018, but not on or prior to Oct. 19, 2017.

GlideRite 1½ inches Knurled Knob, wayfair.com, https://www.wayfair.com/home-improvement/pdp/gliderite-hardware-1-12-diameter-round-knob-hbty1266.html?piid=44148283 (Year: 2020).

Carrlane Adjustable Torque Knobs, Knurled Knobs and Screw Clamps, apexindustrialsupply.com, https://apexindustrialsupply.com/carrlane-adjustable-torque-knob-cl-5-atk/ (Year: 2020).

PlankHardware Knurled Knob, etsy.com, https://www.etsy.com/listing/699993765/large-knurled-button-cabinet-knobs?ga_order=most_relevant&ga_search_type=all&ga_search_query=knurling&ref=sr_gallery-1-5&col=1 (Year: 2020).

Product Listing for Amazon RIGERS T-Bar from: https://us.amazon.com/RIGERS-T-Bar-Landmine-Power-Attachment/dp/B07CQQH9HB, dated Apr. 28, 2018. (Year: 2018).

Homemade T-Bar Row, "http://www.home-gym-bodybuilding.com/homemade-t-bar-row.html#comment-685392007," Oct. 22, 2008 (Year: 2008).

Youtube, Rogue Attachment Post Review, Nov. 8, 2019., https://www.youtube.com/watch?v=B3gAHfNUbNg. (Year: 2019).

Roguefitness, "Rogue Monster Attachment Post", Nov. 1, 2021. https://www.roguefitness.com/rogue-monster-attachment-post. Shown on p. 1. (Year: 2021).

* cited by examiner

SECTION A-A

CONNECTOR ASSEMBLY

CROSS-REFERENCE TO RELATED APPLICATION

This application is a continuation of U.S. patent application Ser. No. 17/750,778, filed May 23, 2022, which is a continuation of U.S. patent application Ser. No. 16/657,531, filed Oct. 18, 2019, which claims priority to U.S. Provisional Application No. 62/747,953, filed Oct. 19, 2018. All of the above referenced applications are herein incorporated by reference in their entirety.

FIELD

Aspects of this disclosure relate generally to a connector assembly for a weightlifting apparatus, and more particularly, to a connector assembly for a weightlifting apparatus having first and second annular knobs positioned on a shaft.

BACKGROUND

A weight rack assembly for weightlifting often includes a frame member to which various devices, accessories, or components are removably attached. For example, various rollers, arms, and bars may be removably secured to a frame member for use by an individual during a weightlifting exercise. Due to size differences between the various individuals that may be using the devices, as well as personal preference, such devices often need to be attached to the frame member at different locations. It is important to be able to ensure that the devices are attached securely to the frame member, and it is also advantageous to be able to remove and attach the devices from the frame member quickly and easily.

SUMMARY

In accordance with a first aspect, a connector assembly for a weightlifting apparatus may include a shaft having a first end and an opposed second end. A first annular knob may be fixed to the shaft proximate the first end of the shaft and include an axially inward front face, an axially outward rear face, and a first central passage that receives the shaft, the first central passage having a first section having a first width, a second section having a second width, and a third section having a third width, the first width being greater than the third width, and the second width being greater than the first width, the second section defining an annular slot between the first section and the third section. A second annular knob may be spaced from the first annular knob along the shaft, the second annular knob may be releasably engaged with the shaft such that the second annular knob is configured to be moveable axially along the shaft, and include an axially inward front face, an axially outward rear face, and a second central passage that receives the shaft, the second central passage having a first section having a first width, a second section having a second width, and a third section having a third width, the first width being greater than the third width, and the second width being greater than the first width, the second section defining an annular slot between the first section and the third section.

In accordance with another aspect, a connector assembly for a weightlifting apparatus may include a shaft having a first end and an opposed second end. A first annular knob may be fixed to the first end of the shaft and include an axially inward facing front face, an axially outward facing rear face, a first central passage that receives the shaft, and an engaging section including an annular slot. A second annular knob may be releasably engaged with the shaft at a position spaced from the first annular knob, and include an axially inward facing front face, an axially outward facing rear face, a second central passage that receives the shaft, and an engaging section including an annular slot. A first spacer may abut the front face of the first annular knob and include a central passage that receives the shaft, a portion of the first spacer being received in the annular slot in the engaging section of the first annular knob to connect the first spacer to the first annular knob. A second spacer may abut the front face of the second annular knob and include a central passage that receives the shaft, a portion of the second spacer being received in the annular slot in the engaging section of the second annular knob to connect the second spacer to the second annular knob.

In accordance with a further aspect, a connector assembly for a weightlifting apparatus may include a cylindrical shaft having a beveled first end, an opposed beveled second end, a recess formed therein proximate the first end, and a threaded portion. A first annular knob may be connected to the shaft proximate the first end of the shaft and include a knurled exterior surface, a threaded aperture extending therethrough, an axially inward facing front face, an axially outward facing rear face, and a first central passage that receives the shaft, the first central passage having a first section having a first width, a second section having a second width, and a third section having a third width, the first width being greater than the third width, and the second width being greater than the first width, the second section defining an annular slot between the first section and the third section, axially inner and outer peripheral edges of the central passage being beveled. A set screw may matingly engage the threaded aperture and be received in the recess in the shaft thereby fixing the first annular knob to the shaft. A second annular knob may be connected to the shaft and spaced from the first annular knob along the shaft and include a knurled exterior surface, an axially inward front face, an axially outward rear face, and a second central passage that receives the shaft, the second central passage having a first section having a first width, a second section having a second width, and a third section having a third width and threads that matingly engage the threaded portion of the shaft to releasably secure the second annular knob to the shaft, the first width being greater than the third width, and the second width being greater than the first width, the second section defining an annular slot between the first section and the third section, axially inner and outer peripheral edges of the central passage being beveled. A first spacer may abut the front face of the first annular knob and include a spacer body, a wall extending axially outwardly from the spacer body, and a lip extending radially outwardly from the wall, the lip being received in the annular slot in the first annular knob to connect the first spacer to the first annular knob, with an axially outer peripheral edge of the lip being beveled. In this configuration, the spacer body, the wall, and the lip define a central passage in the first spacer that receives the shaft. A second spacer may abut the front face of the second annular knob and include a spacer body, a wall extending axially outwardly from the spacer body, and a lip extending radially outwardly from the wall, the lip being received in the annular slot in the second annular knob to connect the second spacer to the second annular knob, with an axially outer peripheral edge of the lip being beveled. In this configuration, the spacer body, the wall, and the lip define a central passage in the second spacer that receives the shaft.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

DETAILED DESCRIPTION

Figure 1:
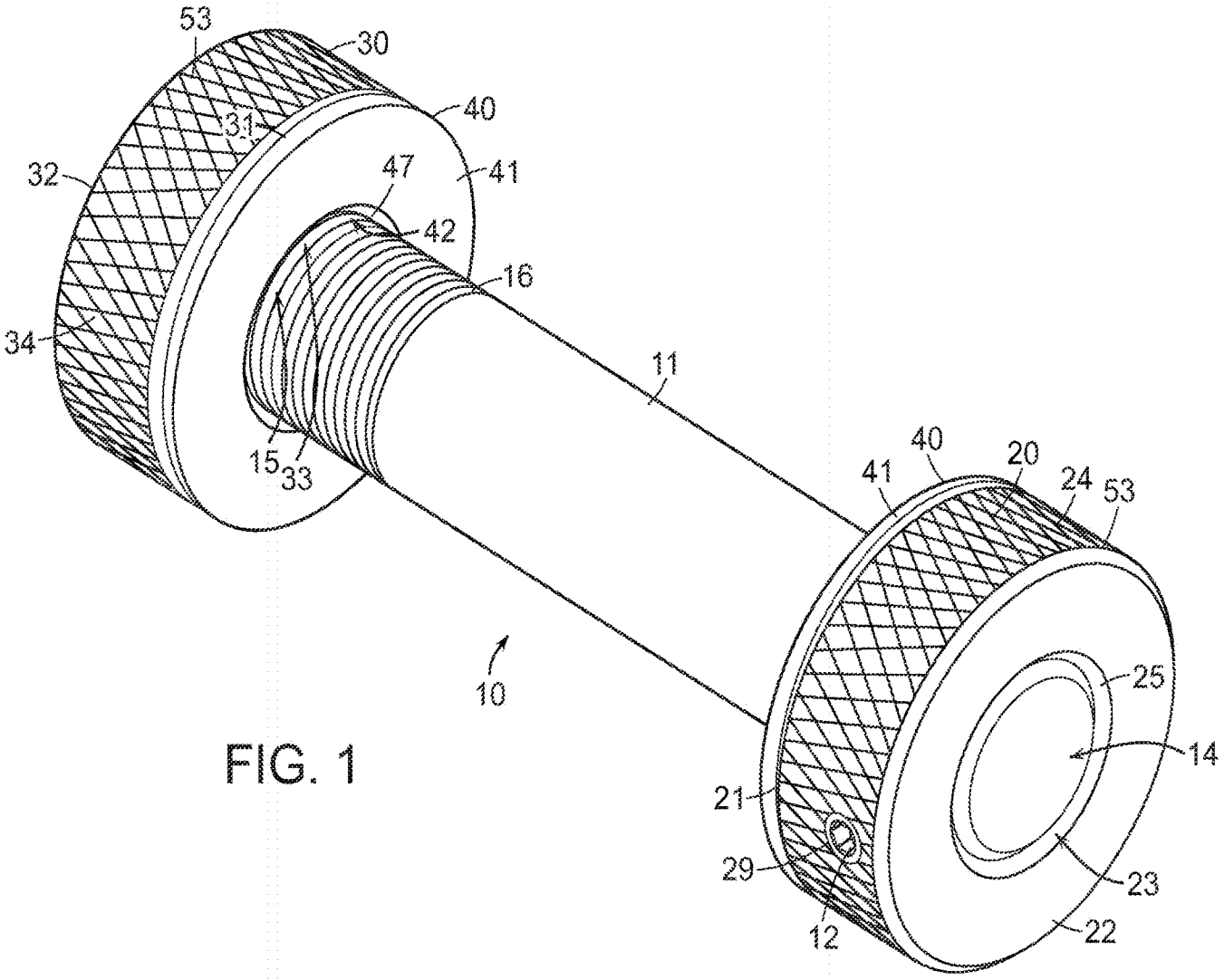
FIG. 1 is a perspective view of one embodiment of a connector assembly according to aspects of the disclosure and components of the assembly.
Figure 2:
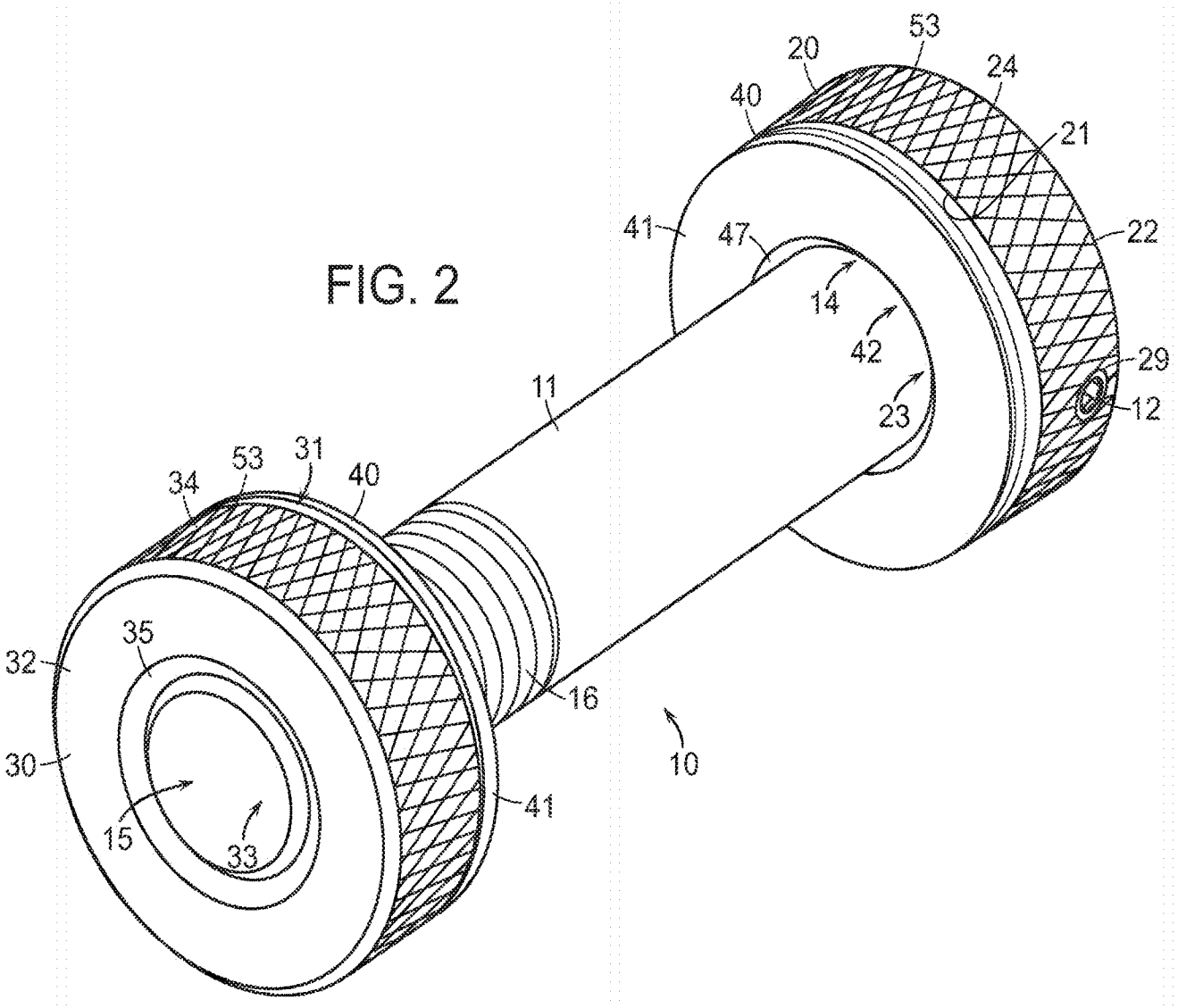
FIG. 2 is another perspective view of the connector assembly of FIG. 1.

The term "approximately" as used herein is meant to mean close to, or about a particular value, within the constraints of sensible commercial engineering objectives, costs, manufacturing tolerances, and capabilities in the field of weight lifting assembly manufacturing and use. Similarly, the term "substantially" as used herein is meant to mean mostly, or almost the same as, within the constraints of sensible commercial engineering objectives, costs, manufacturing tolerances, and capabilities in the field of weight lifting assembly manufacturing and use.

In certain embodiments, specifications including dimensions listed herein may vary by +/−5% or +/−10% of the nominal values identified. In other embodiments, the dimensional specifications may vary by +/−0.05 inch or +/−0.03 inch.

FIGS. 1-13 illustrate one example embodiment of a connection pin or connector assembly 10, according to aspects of the disclosure. The connector assembly 10 in FIGS. 1-13 may include a pin or shaft 11 having a pair of engagement members 20, 30 connected to the shaft 11 at locations spaced from each other along the length of the shaft 11. In the embodiment of FIGS. 1-13, the assembly 10 has a first, fixed engagement member 20 connected to the shaft 11 proximate a first end 14 of the shaft 11 and a second, removable and/or adjustable engagement member 30 connected to the shaft 11 proximate a second end 15 of the shaft 11 opposite the first end 14. It is understood that the first engagement member 20 is actually removable from the shaft 11 in the embodiment of FIGS. 1-13, and may further be configured to be axially and/or rotationally adjustable in other embodiments. Therefore, the term "fixed" in this usage refers to the functionality of the engagement member 20 in typical use, where the first engagement member 20 is not removed from the shaft 11, and the engagement member 20 is fixed in position relative to the shaft 11 by engaging structure configured for such fixing, as described herein. In another embodiment, the connector assembly 10 may be provided with two removable and/or adjustable engagement members 30. The connector assembly 10 is configured for connection to a structure 17 (see FIG. 3) such that the shaft 11 extends through the structure 17, e.g., through one or more holes, openings, or passages. The structure 17 could be a frame member of a weightlifting apparatus such as a weight rack assembly (e.g., a rack or rig), for example.

The shaft 11 in the embodiment of FIGS. 1-13 is an elongated cylindrical body that extends axially between first end 14 and second end 15. The shaft 11 in this embodiment has a threaded portion 16 extending from the second end 15 axially inward along at least a portion of the length of the shaft 11, for engagement with a releasable engagement structure of the second engagement member 30 as described herein.

Figure 3:
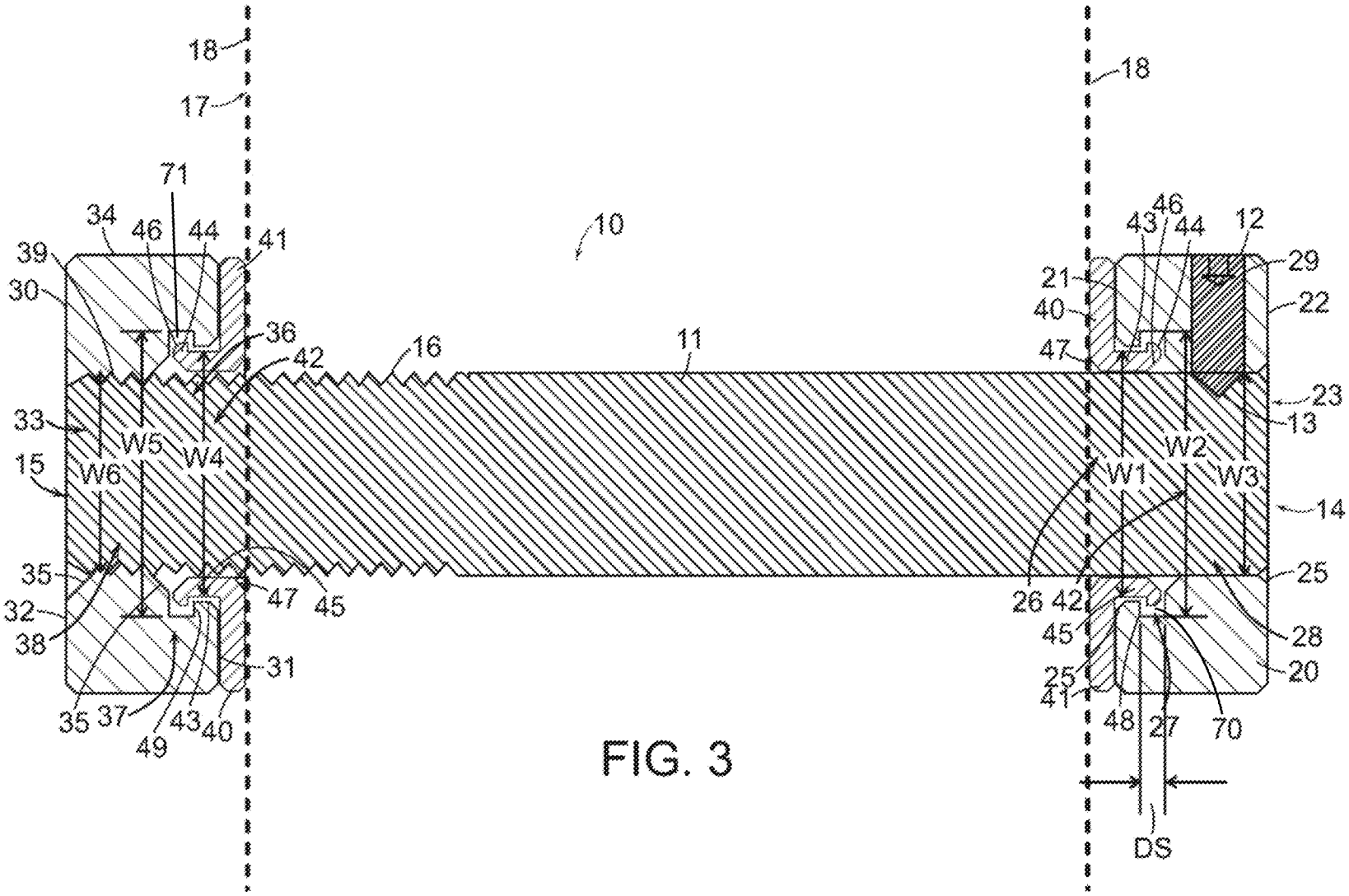
FIG. 3 is a section view of the connector assembly of FIG. 1, shown in an installed configuration on a frame member of a weight rack assembly.
Figure 4:
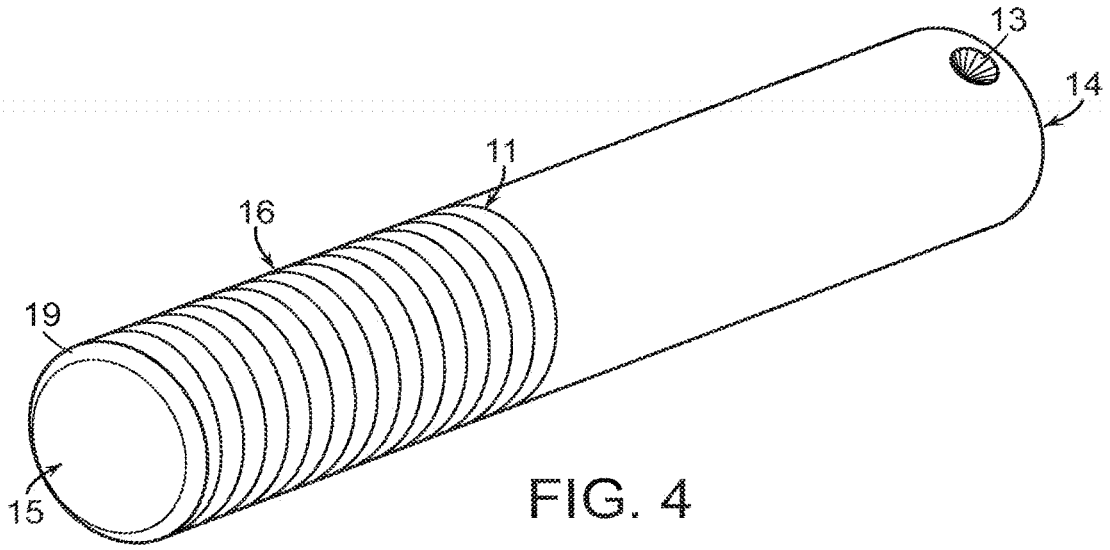
FIG. 4 is a perspective view of a shaft of the connector assembly of FIG. 1.
Figure 5:
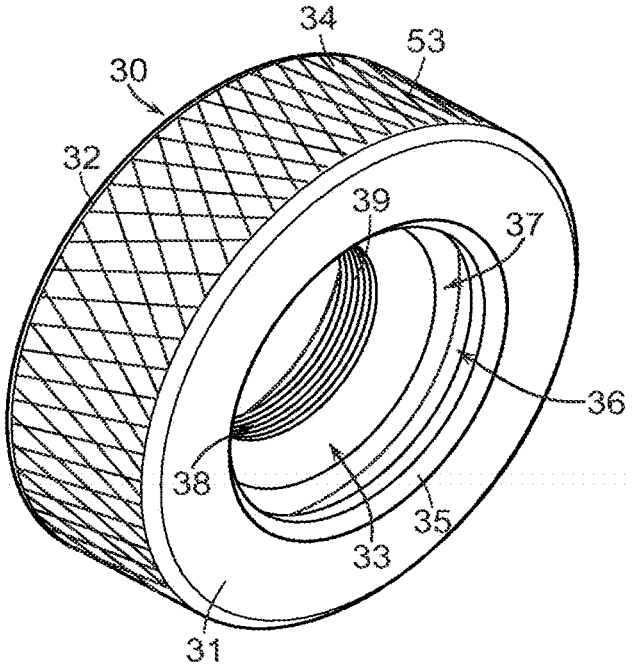
FIG. 5 is a perspective view of an engagement member of the connector assembly of FIG. 1, in the form of an annular knob.
Figure 6:
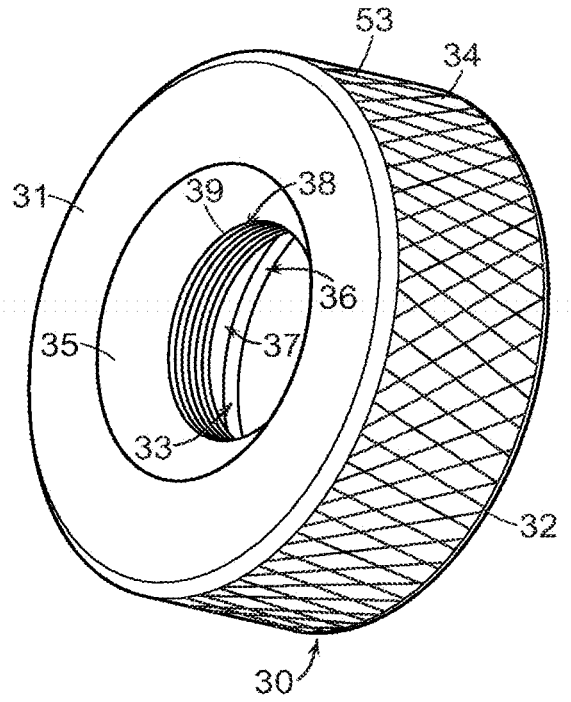
FIG. 6 is another perspective view of the annular knob of FIG. 4.

The shaft 11 in this embodiment also may have a receiver or recess 13 proximate the first end 14 for engagement with a fixed engagement structure of the first engagement member 20 as described herein. The first end 14 and second end 15 of the shaft 11, as seen in FIG. 3, may have beveled or chamfered edges 19 in order to aid insertion of the ends 14, 15 into various openings and passages. The edges 19 may be beveled at approximately 45° in certain embodiments.

The first engagement member 20 in the embodiment of FIGS. 1-13 is in the form of a first annular knob 20 that has an annular front face 21, an annular rear face 22, a central passage 23 extending from the front face 21 to the rear face 22, and a cylindrical peripheral outer surface 24. The front and rear faces 21, 22 of the first engagement member 20 in FIGS. 1-13 may have beveled or chamfered edges 25 around the axially inner and outer peripheral edges of, or openings to, the central passage 23, in order to ease insertion of the shaft 11 into the first engagement member 20 and/or placement of the first engagement member 20 onto the shaft 11. The edges 25 may be beveled at approximately 45° in certain embodiments. In certain embodiments, the peripheral outer surface 24 of the first engagement member 20 may have knurling 53 or other gripping enhancement structure, such as other textures and/or applied coatings. It is to be appreciated that in other embodiments, the peripheral outer surface 24 of the first engagement member 20 may be free of any gripping enhancement structure.

The central passage 23 in this embodiment includes a first section 26 having a first width W1, or diameter in the case where central passage 23 is cylindrical, a second section 27 having a second width or diameter W2, and a third section 28 having a third width or diameter W3, where width W3 of the third section 28 is the smallest width of the three sections, the width W2 of the second section 27 is the largest width of the three sections, and the width W1 of the first section 26 is a width between width W2 of the second section 27 and width W3 of third section 28.

In certain embodiments, W1 may be approximately 1.200 inches, W2 may be approximately 1.399 inches, and W3 may be approximately 1.010 inches. The first engagement member 20 may have an outer diameter DF of approximately 2.141 inches, and a depth DD of approximately 0.750 inches.

In the embodiment of FIGS. 1-13, the second section 27 of the first engagement member 20 is formed as an annular slot 70 that extends around the inside of the central passage 23. In the illustrated embodiment, an axially inner end of third section 28 may have an additional chamfered edge 25 where second section 27 begins. The narrower width W3 of the third section 28 is configured to be similar to the width, or diameter, of the shaft 11, such that the shaft 11 extends through the third section 28 and either engages or is in very close proximity to the inner surface of the third section 28, providing little room for relative movement between the shaft 11 and the first engagement member 20.

Figure 13:
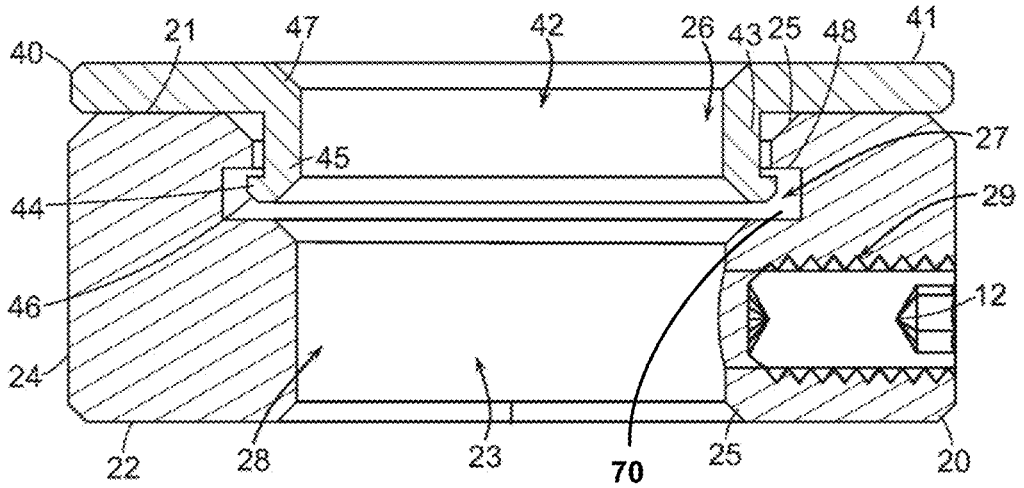
FIG. 13 is a section view of the annular knob of FIG. 12, shown with the spacer of FIG. 7.

The first engagement member 20 may include a fixed engagement structure that fixedly engages with the third section 28 of shaft 11. In the illustrated embodiment, the fixed engagement structure includes a set screw 12 that is received in a through a hole or aperture 29 that extends inward from the peripheral outer surface 24 of the first engagement member 20 to the third section 28, permitting the set screw 12 to engage the shaft 11, thereby fixedly engaging the first engagement member 20 to the shaft 11. As seen in FIG. 13, the set screw 12 and the aperture 29 have mating or complementary threading in this configuration. Additionally, the set screw 12 is received in the recess 13 on the shaft 11 to further secure the connection. In another embodiment, the first engagement member 20 may be fixedly connected to the shaft 11 by a different connection structure, and the shaft 11 may include a complementary structure, such as a pin/hole, tab/slot, or other connection structure.

In certain embodiments, the second section 27 may have a depth DS in an axial direction of approximately 0.125 inches, as seen in FIG. 3.

The removable/adjustable second engagement member 30 in FIGS. 1-13 is configured to be easily removable from the shaft 11 and axially adjustable to a plurality of axial positions when connected to the shaft 11. The connector assembly 10 may include a removable and/or adjustable connecting structure for creating a removable and/or adjustable connection between the second engagement member 30 and the shaft 11, which may be in the form of a complementary releasable engagement structure. In the embodiment of FIGS. 1-13, the second engagement member 30 may include a releasable engagement structure in the form of threading 39 formed on the second engagement member 30 that engages with complementary threading 16 on the shaft 11. In other embodiments, other removable and/or adjustable connection structures may be used to connect the second engagement member 30 to the shaft 11.

The second engagement member 30 in the embodiment of FIGS. 1-13 is in the form of a second annular knob 30 that has an annular front face 31, an annular rear face 32, a central passage 33 extending from front face 31 to rear face 32, and a cylindrical peripheral outer surface 34. The front and rear faces 31, 32 of the second engagement member 30 in FIGS. 1-13 may have beveled or chamfered edges 35 around the axially inner and outer peripheral edges of, or openings to, the central passage 33, in order to ease insertion of the shaft 11 into the second engagement member 30 and/or placement of the second engagement member 30 onto shaft 11. The edges 35 may be beveled at approximately 45° in certain embodiments. In certain embodiments, the peripheral outer surface 34 of the second engagement member 30 may have knurling 53, or other gripping enhancement structure, such as other textures and/or applied coatings. It is to be appreciated that in other embodiments, the peripheral outer surface 34 of the second engagement member 30 may be free of any gripping enhancement structure.

The central passage 33 in this embodiment includes a first section 36 having a first width W4, or diameter in the case where central passage 33 is cylindrical, a second section 37 having a second width or diameter W5, and a third section 38 having a third width or diameter W6, where the width W6 of the third section 38 is the smallest width of the three sections, the width W5 of the second section 37 is the largest width, and the width W4 of the first section 36 is a width between the width W5 of the second section 37 and the width W6 of the third section 38.

In the embodiment of FIGS. 1-13, the second section 37 of the second engagement member 30 is formed as an annular slot 71 that extends around the inside of the central passage 33. In the illustrated embodiment, an axially inner end of the third section 38 may have an additional chamfered edge 25 where the second section 37 begins. The narrower width W6 of the third section 38 is configured to be similar to the width of the shaft 11, and in the embodiment of FIGS. 1-13, the third section 38 has threading 39 around the inner surface that threadingly engages the threaded portion 16 of the shaft 11. The mating engagement between the threading 39 and the threaded portion 16 permits axial advancement (i.e., inward from the second end 15 of the shaft 11 and toward the first end 14 and the first engagement member 20) and axial retreat (opposite to advancement) by rotation of the second engagement member 30.

The connector assembly 10 in FIGS. 1-13 may include spacers 40 positioned to cover at least a portion of each of the front faces 21, 31 of the first and second engagement members 20, 30, respectively. In this position, the spacers 40 are configured to be engaged between the front faces 21, 31 of the first and second engagement members 20, 30 and the opposed outer surfaces 18 of the structure 17 that the shaft 11 extends through, as shown in FIG. 3. The structure 17 may be, for example, a frame or frame member of a weight rack assembly. In the embodiment of FIGS. 1-13, the two spacers 40 are substantially identical pieces, but it is to be appreciated that the spacers 40 may be differently configured in other embodiments.

Figure 8:
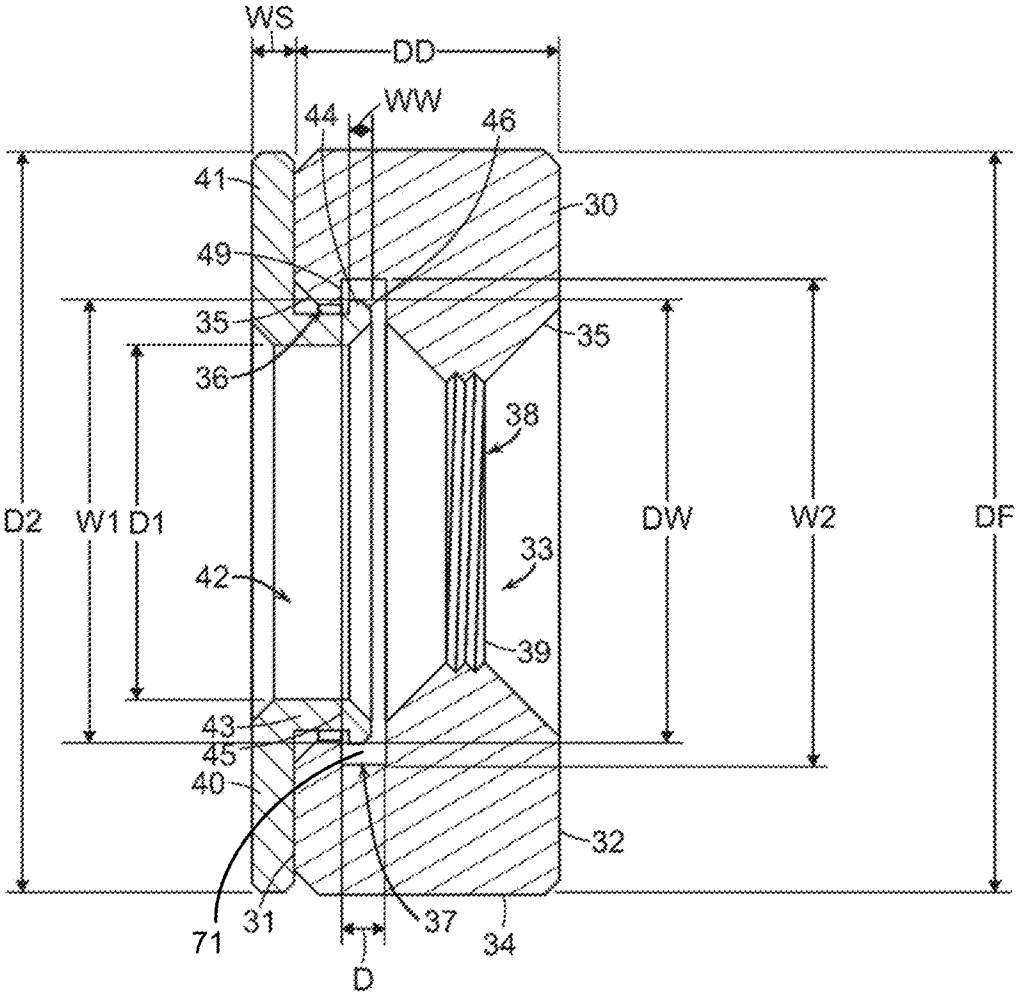
FIG. 8 is a section view of the annular knob of FIG. 4, shown with the spacer of FIG. 7.
Figure 7:
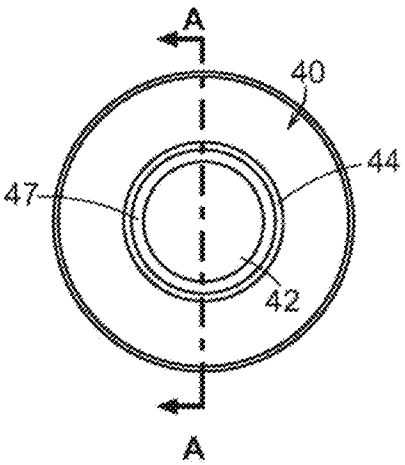
FIG. 7 is an end elevation view of a spacer of the connector assembly of FIG. 1.
Figure 9:
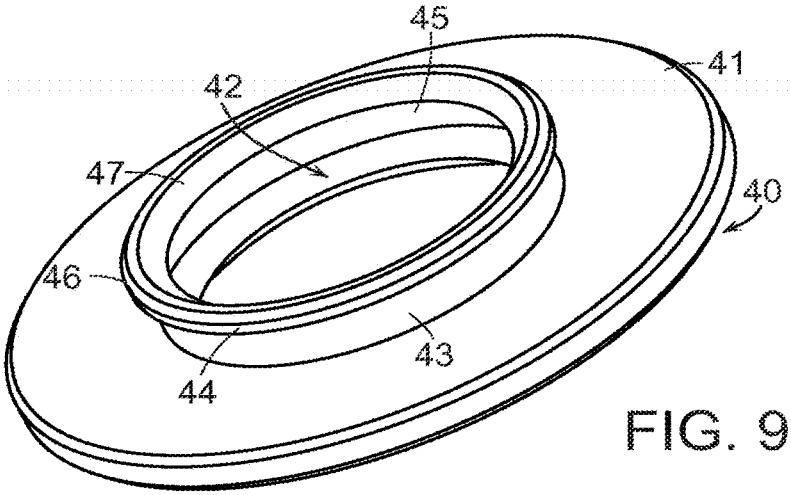
FIG. 9 is a perspective view of the spacer of FIG. 7.
Figure 10:
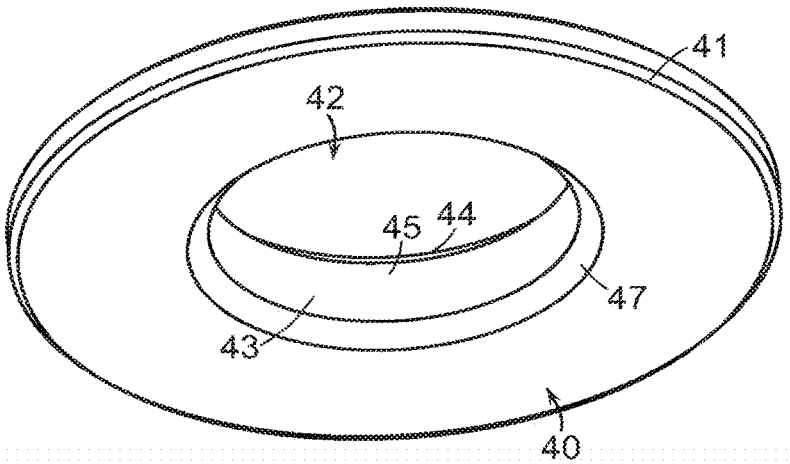
FIG. 10 is another perspective view of the spacer of FIG. 7.
Figure 11:
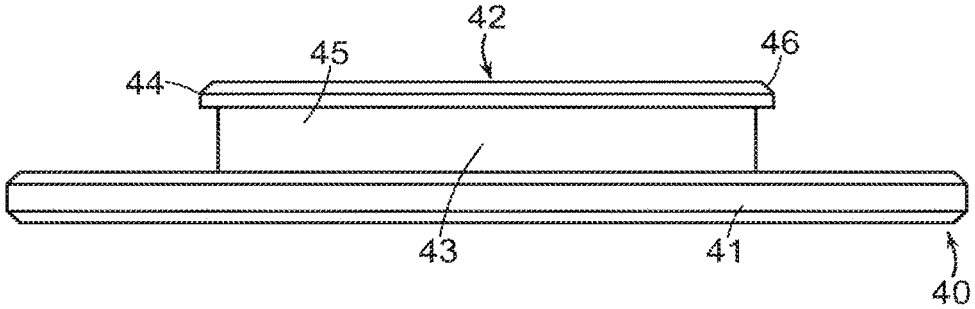
FIG. 11 is a side elevation view of the spacer of FIG. 7.
Figure 12:
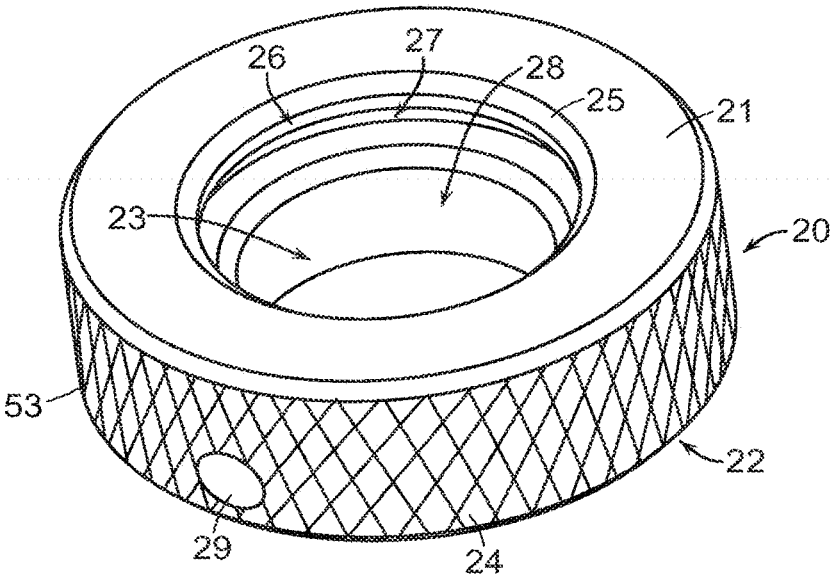
FIG. 12 is a perspective view of a second engagement member of the connector assembly of FIG. 1, in the form of an annular knob.

The spacers 40 in FIGS. 1-13 may be fixedly engaged with the first and second engagement members 20, 30, and the spacers 40 may include connecting structure for engaging the first and second engagement members 20, 30 to achieve this connection. In the embodiment of FIGS. 1-13, each spacer 40 includes an annular spacer body 41 having a circular central passage 42 therethrough, a wall 43 extending outward from the spacer body 41, and a lip 44 extending transversely outward from the wall 43. The lip 44 in this embodiment extends generally parallel to the plane of the spacer body 41, or radially with respect to the central passage 42 and the shaft 11 when mounted, and the wall 43 extends generally perpendicular to the plane of the spacer body 41, or axially with respect to the central passage 42 and the shaft 11 when mounted. In the embodiment of FIGS. 1-13, the wall 43 is in the form of a cylindrical wall 43 that extends around the entire central passage 42, such that the central passage 42 extends continuously through the spacer body 41 and the wall 43. The wall 43 and the spacer body 41 both define equal inner diameters or widths D1 in this embodiment. In certain embodiments, as seen in FIG. 8, the diameters or widths D1 may be approximately 1.025 inches. The spacer body 41 may have an outer diameter or width D2 of approximately 2.125 inches and a depth or thickness WS of approximately 0.125 inches. The lip 44 may have a depth or thickness WW of approximately 0.063 inches and an outer diameter or width DW of approximately 1.275 inches.

The lip 44 in FIGS. 1-13 may extend outward around the entire periphery of the wall 43 at the distal end 45 of the wall 43 relative to the spacer body 41, and the lip 44 further may have a beveled or ramped surface 46 at its axially outward peripheral edge. In other embodiments, the wall 43 may not extend continuously around the passage 42, or the lip 44 may not extend continuously around the wall 43, e.g., the spacer 40 may include a plurality of separate walls 43 each having a lip 44, or one or more walls 43 each having one or more separate lips 44. The spacer 40 may have beveled or chamfered surfaces 47 at both ends of the central passage 42 in one embodiment. The surfaces 47 may be beveled at approximately 45° in certain embodiments.

In the embodiment of FIGS. 1-13, the wall 43 and the lip 44 together form the connection structure for connecting the spacer 40 to the first and second engagement members 20, 30. The spacer 40 is connected to the first engagement member 20 by the lip 44 being received within the second section 27 (i.e., the annular recess) and engaging an engagement surface 48 formed by the change in width or diameter between the first and second sections 26, 27. The wall 43 extends through the first section 26 in this arrangement, and the width W1 of the first section 26 is similar to the outer width/diameter of the wall 43, to limit movement of the spacer 40 with respect to the first engagement member 20. The spacer 40 is inserted into the central passage 23 of first engagement member 20 from the front face 21, and the ramped surface 46 of the lip 44 engages the first engagement member 20, e.g., the chamfered edge 25 at the front face 21, to flex the lip 44 and/or the wall 43 radially inward during insertion. Upon clearing the first section 26, the lip 44 expands outward to engage the engagement surface 48 and retain the spacer 40 in connection with the first engagement member 20.

The spacer 40 is connected to the second engagement member 30 similarly to the first engagement member 20, by the lip 44 being received within the second section 37 (i.e., the annular recess) and engaging an engagement surface 49 formed by the change in diameter between the first and second sections 36, 37. The wall 43 extends through the first section 36 in this arrangement, and the width W4 of the first section 36 is similar to the outer width/diameter of the wall 43, to limit movement of the spacer 40 with respect to the second engagement member 30. The spacer 40 is inserted into the central passage 33 from the front face 31, and the ramped surface 46 of the lip 44 engages the second engagement member 30, e.g., the chamfered edge 35 at the front face 31, to flex the lip 44 and/or the wall 43 radially inward during insertion. Upon clearing the first section 36, the lip 44 expands outward to engage the engagement surface 49 and retain the spacer 40 in connection with the second engagement member 30.

Figure 20:
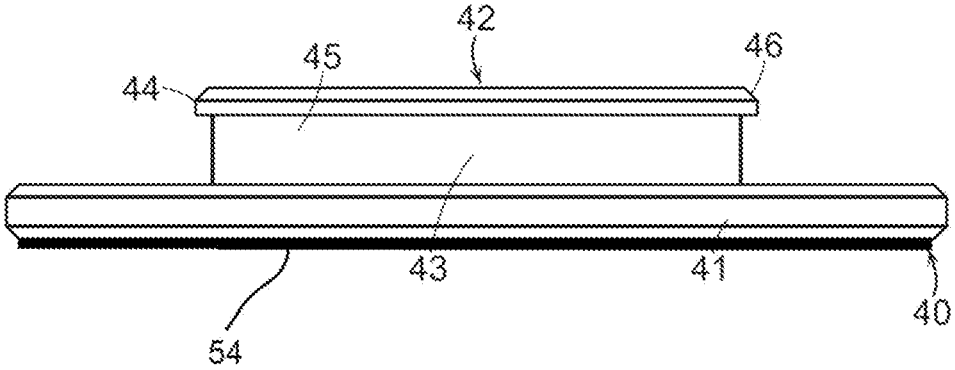
FIG. 20 is a side elevation view of an alternative embodiment of a spacer for use with the connector assembly of FIG. 1 according to aspects of the disclosure.

The first engagement member 20 in FIGS. 1-13 is fixedly connected to the shaft 11 proximate the first end 14 using the set screw 12, as described above. In order to connect the connector assembly 10 to the structure 17, the second engagement member 30 is removed from the shaft 11, and the second end 15 of shaft 11 is inserted into and through the structure 17, e.g., through one or more openings or passages. The second engagement member 30 is then connected to the second end 15 of the shaft 11 by engagement of the threading 39 of the second engagement member 30 with the threaded portion 16 of the shaft 11 and then axially adjusted by rotation along the threaded portion 16 to operably engage the outer surface 18 of the structure 17, as shown in FIG. 3. Axially inward facing surfaces of the spacers 40 of the first and second engagement members 20, 30 engage the outer surfaces 18 of the structure 17 in this embodiment, and further rotation of the second engagement member 30 to achieve axial advancement toward the first engagement member 20 compresses the spacers 40 between the engagement members 20, 30 and the structure 17. The front surfaces 21, 31 of the engagement members 20, 30 are moved toward one another and toward the outer surfaces 18 of the structure 17 in this configuration as second engagement member 30 is moved axially along shaft 11. The spacers 40 engage the structure 17 to protect the structure 17 from damage that may occur by engagement by the engagement members 20, 30 (which may be made from harder materials, such as metal), such as damaging the paint or other finish on the structure 17. The locking engagement between the spacers 40 and the engagement members 20, 30 avoid the need for separate protective members that may be dropped or lost during connection of the connector assembly 10 to the structure 17. Additionally, the compression of the spacer 40 of the second engagement member 30 in particular may create friction between the spacer 40 and the structure 17, and between the spacer 40 and the front face 31 of second engagement member 30 to resist unwanted rotation and axial retreat of the second engagement member 30. This creates a secure, stable, and rigid connection that is easily achieved and also easily released by manual counter-rotation of the second engagement member 30 to achieve axial retreat thereof. The relatively large outer diameter and grip-enhancing structures (e.g., knurling) on the peripheral outer surface 34 of the second engagement member 30 may assist in applying sufficient torque for tightening and releasing the second engagement member 30 with respect to shaft 11. In another embodiment, one or both of the spacers 40 may have a friction enhancing structure 54 on the surface of the spacer 40 confronting the structure 17, as shown in FIG. 20, in order to further resist unwanted rotation and axial retreat of the second engagement member 30. The friction enhancing structure 54 may be a coating adhered to the spacer 40, such as a rubber layer connected to the spacer 40 by a bonding material. Additionally, the friction enhancing structure 54 may be softer (i.e., lower hardness) and/or more compressible than the material of the spacer 40. In a further embodiment, the engagement members 20, 30 may not include spacers 40, and the front faces 21, 31 may directly engage the structure 17. In such an embodiment, the front faces 21, 31 may have a friction enhancing structure (e.g., a coating adhered to the faces 21, 31) similar to the friction enhancing structure 54 of FIG. 20 described herein.

In one embodiment, the shaft 11 and the first and second engagement members 20, 30 may be made of strong and hard materials, while the spacers 40 may be formed of materials that have lower strength and hardness and/or are more compressible than the materials of first and second engagement members 20, 30. Thus, the spacers 40 may be formed of a first material having a hardness that is less than a hardness of a second material used to form the shaft 11 and/or the first and second engagement members 20, 30. For example, the first material used to form the spacers 40 may be a polymer material (e.g., acetal or UHMW polyethylene), while the second material used to form the first and second engagement member 20, 30 and/or the shaft 11 may be a metallic material (e.g., stainless steel or low carbon steel). In one embodiment, the spacer 40 may be formed of a plastic material having a hardness of approximately 80-85 Shore D, and the engagement members 20, 30 may be formed of a metal material (e.g., 1018 steel or 303 stainless steel) having a hardness of approximately 70-96 Rockwell B.

Figure 19:
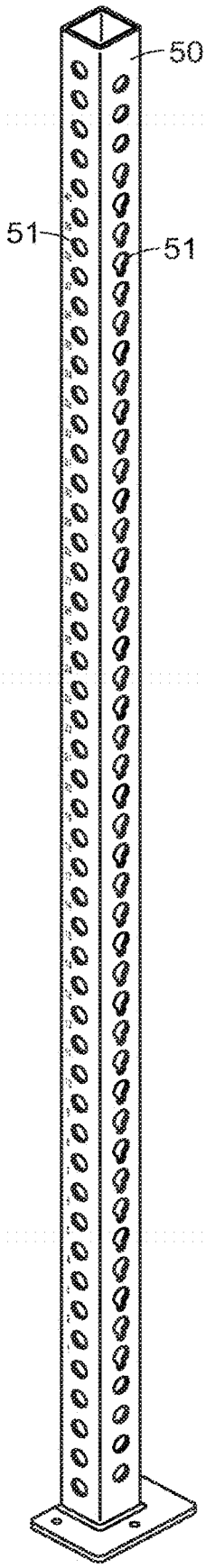
FIG. 19 is a perspective view of a frame member to which the connector assembly of FIG. 1 can be connected.

FIG. 19 illustrates one embodiment of a structure 17 for mounting of the connector assembly 10 in the form of a frame member 50 of a weight rack assembly having a square cross section. The frame member 50 includes a plurality of holes 51 extending therethrough in both directions, and the connector assembly 10 may be connected to the frame member 50 by the shaft 11 extending through the holes 51. A component may be mounted to the frame member 50 by inserting the shaft 11 through one or more openings in the component and one or more of the holes 51 of the frame member 50 and then tightening the second engagement member 30 as described herein. The outer surfaces 18 of the structure 17 may be surfaces of the frame member 50, surfaces of the component, or a combination thereof, depending on the configuration of the component. Other structures may be connected in a similar manner, and it is understood that the assembly is not limited to any particular use, or to connection to any particular structure or connection of any particular structures and components together.

Figure 14:
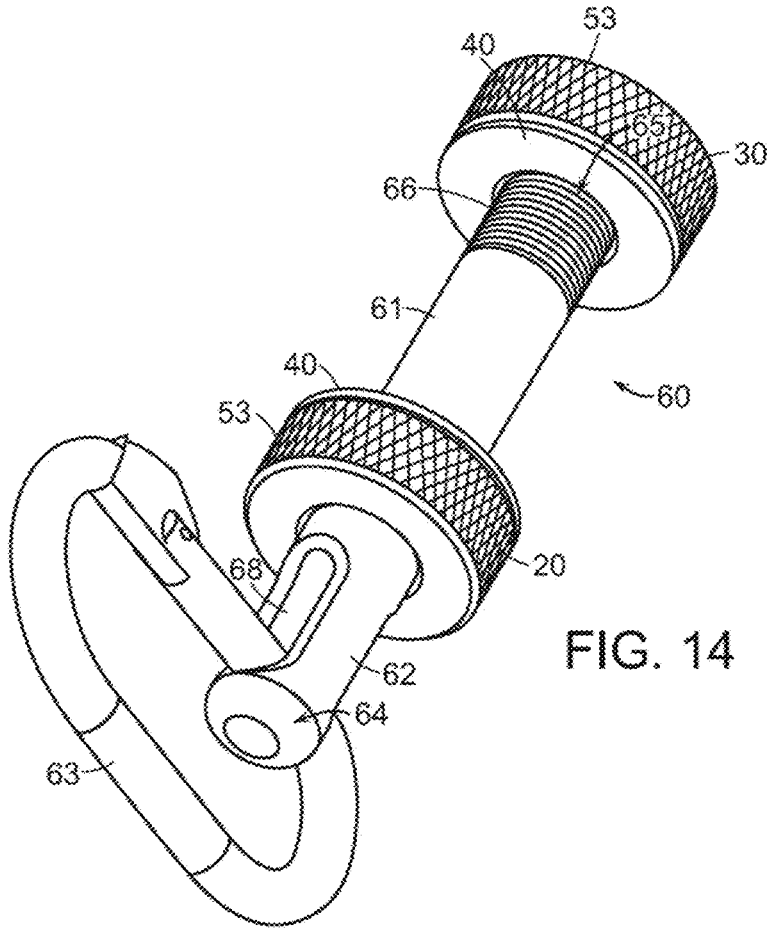
FIG. 14 is a perspective view of an alternative embodiment of the connector assembly of FIG. 1, shown with a component attached to the connector assembly.
Figure 15:
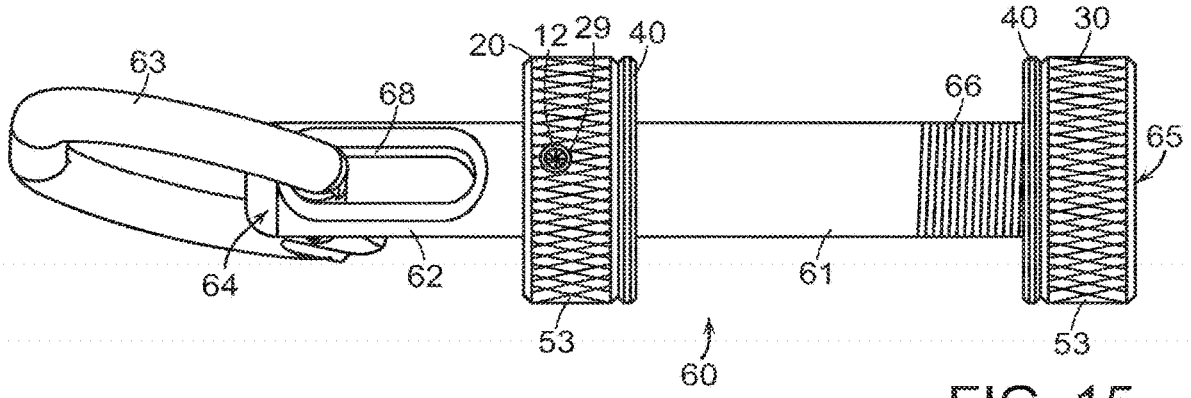
FIG. 15 is an elevation view of the connector assembly of FIG. 14.
Figure 16:
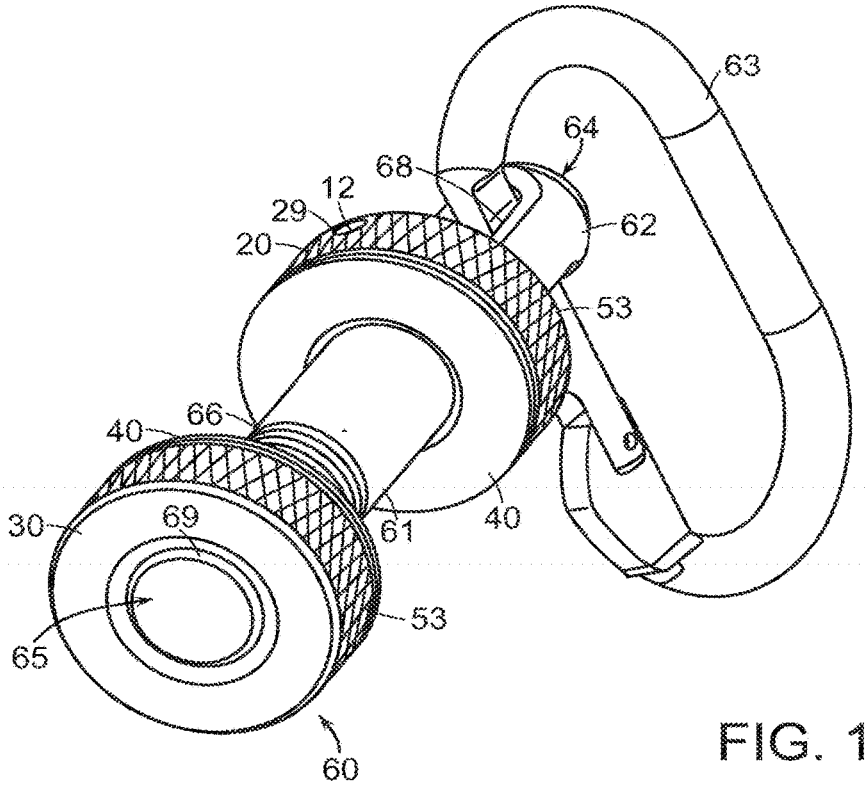
FIG. 16 is another perspective view of the connector assembly of FIG. 14.
Figure 17:
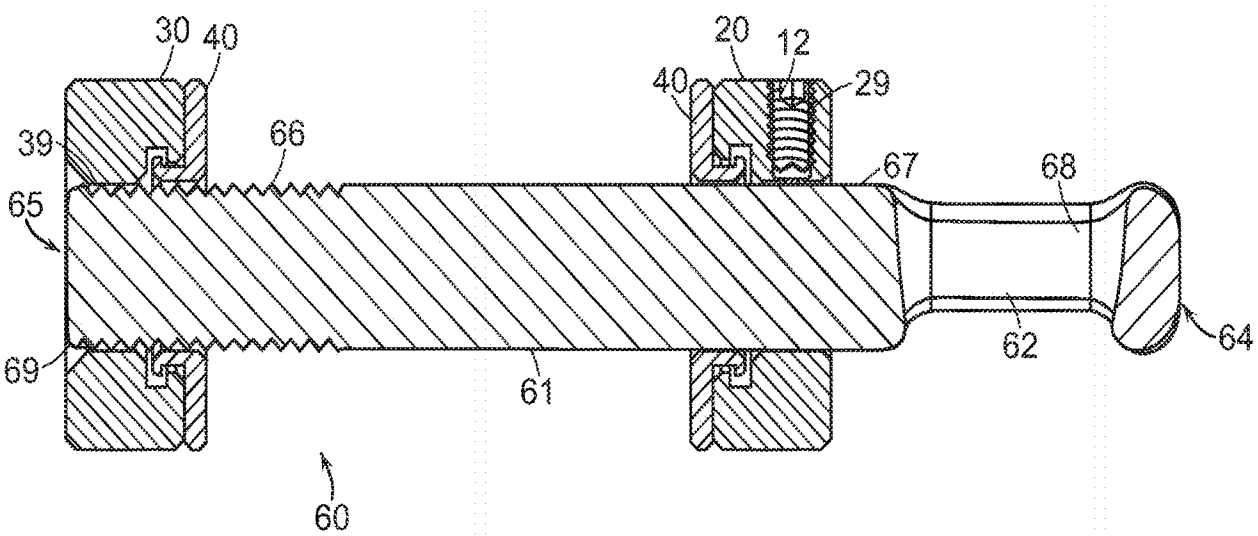
FIG. 17 is a section view of the connector assembly of FIG. 14.
Figure 18:
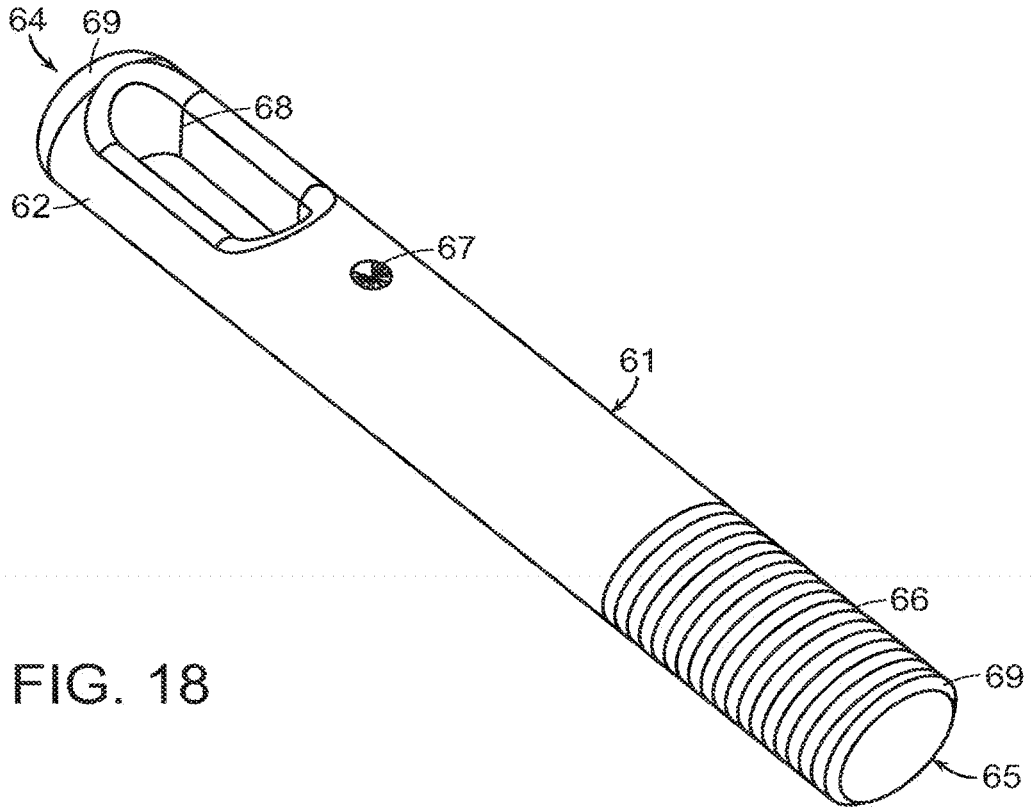
FIG. 18 is perspective view of the shaft of the connector assembly of FIG. 14.

FIGS. 14-18 illustrate another example embodiment of a connector assembly 60 according to aspects of the disclosure. The assembly 60 of FIGS. 14-18 uses first and second engagement members 20, 30 in the form of annular knobs 20, 30 with spacers 40 as described herein, which are identical to the first and second engagement members 20, 30 and the spacers 40 of the connector assembly 10 in FIGS. 1-13. The shaft 61 in FIGS. 14-18 includes a connector 62 configured for connection to another accessory or component 63, such as a karabiner 63 as shown in FIGS. 14-16.

The shaft 61 in the embodiment of FIGS. 14-18 is an elongated cylindrical body that extends axially between opposed first and second ends 64, 65. The shaft 61 in this embodiment has a threaded portion 66 extending from the second end 65 axially along at least a portion of the length of the shaft 61, for engagement with the second engagement member 30 as described herein. The shaft 61 in this embodiment also has a receiver or recess 67 positioned at a location along the shaft 61 between the first and second ends 64, 65 for engagement with the first engagement member 20 (e.g., receiving the set screw 12) as described herein. The second end 65 of the shaft 61 in FIGS. 14-18 may have beveled or chamfered edges 69 in order to aid with insertion of second end 65 into various openings and passages. The edges 69 may be beveled at approximately 45° in certain embodiments. The first end 64 of the shaft 61 may have the connector 62 connected thereto. The shaft 61 of FIGS. 14-18 has the connector 62 formed by an elongated aperture 68 extending through the body of the shaft 61 proximate the first end 64, which is configured to receive the karabiner 63 or various other accessories or components that can connect to the connector 62 by extending through the aperture 68. In this configuration, the recess 67 or other structure of the shaft 61 for engagement with the first engagement member 20 is located between the connector 62 and the second end 65 of the shaft 61, such that when the connection assembly 60 is assembled, the first engagement member 20 is positioned between the connector 62 and the second engagement member 30. In other embodiments, the connector 62 may be formed as a separate component connected to the shaft 61 by bonding or joining materials (e.g., welding, adhesives, etc.), fasteners, locking structures, or other connection techniques, and/or a different type of connector 62, or multiple connectors 62, may be used.

The assembly 60 in FIGS. 14-18 can be connected to a structure 17 in the same manner as the connector assembly 10 in FIGS. 1-13, by first and second engagement members 20, 30 and the spacers 40 engaging the opposed outer surfaces 18 of the structure 17. The assembly 60 in FIGS. 14-18 may be used to connect a component to a frame member 50 or other structure by extending through a portion of the component, as described above. The assembly 60 in FIGS. 14-18 can additionally or alternately be used to connect a component to a frame member 50 or other structure by connecting the assembly 60 to the frame member 50 as described herein and directly or indirectly connecting the component to the connector 62.

It is understood that the assembly 60 in FIGS. 14-18 may include numerous different types of connectors 62 for connection to numerous different devices, fasteners, connecting structures, etc., in other embodiments. In another embodiment, the assembly 60 may have connectors 62 of the same or different types on both ends 64, 65 of the shaft 61, and the shaft 61 may have threading or other releasable connection structure located inward of the second end 65 for connection to the second engagement member 30. In a further embodiment, the connector 62 may be alternately located at the second end 65, and the structure of the connector 62 and position of the threaded portion 66 may be configured to permit advancement of the second engagement member 30 past the connector 62. In this configuration, when the connection assembly 60 is assembled, the second engagement member 30 is positioned between the connector 62 and the first engagement member 20. It is understood that any of the features and components described herein with respect to the connector assembly 10 of FIGS. 1-13 may be used in connection with the assembly 60 of FIGS. 14-18, including any alternate embodiments and configurations, and vice-versa.

It is to be appreciated that the karabiner 63 is only one example of a component that may be attached by way of the connector 62, or another type of connector, to the shaft 61, and that other components suitable for use with weightlifting apparatuses may be attached to the shaft 61 such as rollers, arms, and bars, for example. Other suitable components that can be attached to the shaft 61 by way of a connector will become readily apparent to those skilled in the art, given the benefit of this disclosure.

Various embodiments of connector assemblies 10, 60 have been described herein, which include various components and features. In other embodiments, the assemblies 10, 60 may be provided with any combination of such components and features. It is also understood that in other embodiments, the various devices, components, and features of the assemblies 10, 60 described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Terms "front," "rear," "proximal," "distal," and the like, as used herein, are intended for illustrative purposes only and do not limit the embodiments in any way. When used in description of a method or process, the term "providing" (or variations thereof) as used herein means generally making an article available for further actions, and does not imply that the entity "providing" the article manufactured, assembled, or otherwise produced the article. Nothing in this specification should be construed as requiring a specific three dimensional orientation of structures in order to fall within the scope of this invention, unless explicitly specified by the claims. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A connector assembly for a weightlifting apparatus, the connector assembly comprising:

a shaft comprising a first end, a second end opposite the first end, an elongated cylindrical body extending axially between the first end and the second end, an aperture extending through the shaft proximate the first end, and a first threaded portion extending axially along a portion of a length of the shaft at the second end;

a knob that includes an axially inward facing front face, an axially outward facing rear face, a cylindrical peripheral exterior surface, and a central aperture extending axially outward into the knob from the axially inward facing front face and receiving a portion of the shaft therein, wherein the central aperture includes a first section having a first width and a second section having a second width, the first width being greater than the second width, and wherein the second section receives the first threaded portion of the shaft and comprises a second threaded portion that engages the first threaded portion of the shaft to connect the knob to the shaft, wherein the cylindrical peripheral exterior surface is knurled; and an annular body with a central passage, wherein the annular body has a third width that is greater than the second width, and a portion of the annular body is received in the first section of the knob, and the shaft extends through the central passage and into the central aperture of the knob.

2. The connector assembly of claim 1, further comprising a component connected to the shaft, wherein a portion of the component extends through the aperture, and wherein the component comprises a loop.

3. The connector assembly of claim 2, wherein the component is a karabiner.

4. The connector assembly of claim 2, wherein the component is releasably connected to the shaft.

5. The connector assembly of claim 1, wherein the shaft is formed from stainless steel.

6. The connector assembly of claim 1, wherein the annular body has a hardness that is less than a hardness of the shaft.

7. The connector assembly of claim 1, wherein the first end of the shaft has a reduced diameter portion configured to aid with insertion of the first end into an opening in the weightlifting apparatus.

8. The connector assembly of claim 1, wherein the shaft of the connector assembly is configured to be inserted into an opening of a rectangular frame member of a weight rack assembly.

9. The connector assembly of claim 8, wherein an axially inward facing surface of the annular body is configured to engage an outer surface of the rectangular frame member of the weight rack assembly.

10. A connector assembly for a weightlifting apparatus, the connector assembly comprising:

a shaft comprising a first end, a second end opposite the first end, an elongated cylindrical body extending axially between the first end and the second end, and wherein the first end of the shaft has a reduced diameter portion configured to aid with insertion of the first end into an opening in the weightlifting apparatus;

a knob that includes an axially inward facing front face, an axially outward facing rear face, a cylindrical peripheral exterior surface, and a central aperture extending axially outward into the knob from the axially inward facing front face and receiving a portion of the shaft therein, wherein the central aperture includes a first section having a first width and a second section having a second width, the first width being greater than the second width, wherein the second section receives the second end of the shaft to connect the knob to the shaft, and wherein the first section is located between the second section and the axially inward facing front face, such that the shaft extends axially outward from the first end through the first section and into the second section;

wherein the cylindrical peripheral exterior surface is knurled; and an annular body with a central passage, wherein the annular body has a third width that is greater than the second width, and wherein a portion of the annular body is received in the first section of the knob and the shaft extends through the central passage and into the central aperture of the knob.

11. The connector assembly of claim 10, wherein an axially inward facing surface of the annular body is configured to engage an outer surface of a rectangular frame member of a weight rack assembly.

12. The connector assembly of claim 10, wherein the annular body has a hardness that is less than a hardness of the shaft.

13. The connector assembly of claim 10, wherein at least one of the knob and the shaft is formed from stainless steel.

14. The connector assembly of claim 10, wherein the shaft further comprises a first threaded portion extending axially along a portion of a length of the shaft at the second end; and wherein the second section of the knob receives the first threaded portion of the shaft and comprises a second threaded portion that engages the first threaded portion of the shaft to connect the knob to the shaft.

15. The connector assembly of claim 10, wherein the reduced diameter portion of the shaft is chamfered or beveled.

16. The connector assembly of claim 10, wherein the second end of the shaft has a threaded portion, and wherein the first section of the central aperture is non-threaded, and the second section of the central aperture receives the second end of the shaft and has internal threading engaging the threaded portion of the shaft to connect the knob to the shaft.

17. The connector assembly of claim 10, wherein the central aperture extends axially completely through the knob, from the axially inward facing front face to the axially outward facing rear face.

18. The connector assembly of claim 10, wherein the annular body further includes a second portion that is positioned outside the first section of the knob.

19. A connector assembly for a weightlifting apparatus, the connector assembly comprising:

a shaft comprising a first end, a second end opposite the first end, an elongated cylindrical body extending axially between the first end and the second end, and wherein the first end of the shaft has a reduced diameter portion configured to aid with insertion of the first end into an opening in the weightlifting apparatus;

a knob that includes an axially inward facing front face, an axially outward facing rear face, a cylindrical peripheral exterior surface, and a central aperture extending axially outward into the knob from the axially inward facing front face and receiving a portion of the shaft therein, wherein the central aperture includes a first section having a first width and a second section having a second width, the first width being greater than the second width, and wherein the second section receives the second end of the shaft to connect the knob to the shaft;

wherein the cylindrical peripheral exterior surface is knurled; and an annular body with a central passage, wherein the annular body has a third width that is greater than the second width, and wherein a portion of the annular body is received in the first section of the knob and the shaft extends through the central passage and into the central aperture of the knob, wherein the shaft includes a hole that extends into the shaft, wherein the hole is positioned closer to the first end than the second end.

20. The connector assembly of claim 19, wherein a component is connected to the shaft, wherein a portion of the component is received in the hole.

21. A connector assembly for a weightlifting apparatus, the connector assembly comprising:

a shaft comprising a first end, a second end opposite the first end, an elongated cylindrical body extending axially between the first end and the second end, and an aperture extending into the shaft proximate the first end, wherein the first end of the shaft has a reduced diameter portion, and wherein the shaft is configured to be inserted into an opening of a rectangular frame member of a weight rack assembly;

a knob that includes a knurled peripheral exterior surface having a cylindrical shape, an axially inward facing front face, an axially outward facing rear face, and a central aperture extending axially outward into the knob from the axially inward facing front face and receiving a portion of the shaft therein, wherein the central aperture includes a first section having a first width and a second section having a second width, the first width being greater than the second width, and wherein the second section receives the second end of the shaft to connect the knob to the shaft;

an annular body with a central passage, wherein a portion of the annular body is received in the first section of the knob and the shaft extends through the central passage and into the central aperture of the knob, wherein an axially inward facing surface of the annular body is configured to engage an outer surface of the rectangular frame member of the weight rack assembly; and a component received in the aperture.

22. The connector assembly of claim 21, wherein the annular body has a hardness that is less than a hardness of the shaft.

23. The connector assembly of claim 21, wherein at least one of the shaft and the knob is formed from stainless steel.

24. The connector assembly of claim 21, wherein the annular body is fixedly engaged with the knob.

* * * * *